US007473132B2

(12) United States Patent
Chen

(10) Patent No.: US 7,473,132 B2
(45) Date of Patent: Jan. 6, 2009

(54) IEEE 1394 ELECTRICAL CONNECTOR

(75) Inventor: Chien-Chiu Chen, Taipei (TW)

(73) Assignee: Advanced Connectek Inc., Taipei (TW)

( * ) Notice: Subject to any disclaimer, the term of this patent is extended or adjusted under 35 U.S.C. 154(b) by 0 days.

(21) Appl. No.: 11/688,575

(22) Filed: Mar. 20, 2007

(65) Prior Publication Data

US 2008/0032527 A1 Feb. 7, 2008

Related U.S. Application Data

(63) Continuation-in-part of application No. 11/462,445, filed on Aug. 4, 2006, now abandoned.

(51) Int. Cl.
*H01R 13/648* (2006.01)

(52) U.S. Cl. ..... 439/607

(58) Field of Classification Search ..... 439/607–610
See application file for complete search history.

(56) References Cited

U.S. PATENT DOCUMENTS 4,943,244 A * 7/1990 Teck et al. ..... 439/567
6,120,323 A * 9/2000 Zhung et al. ..... 439/567
6,165,015 A 12/2000 Wu et al.
6,267,623 B1 * 7/2001 Hisamatsu ..... 439/607
6,379,186 B1 * 4/2002 Shi et al. ..... 439/607
6,447,311 B1 * 9/2002 Hu et al. ..... 439/108
6,482,037 B1 * 11/2002 Zhu et al. ..... 439/607
6,554,642 B1 * 4/2003 Xiang et al. ..... 439/567
6,764,339 B2 * 7/2004 Kubo ..... 439/607
2006/0079130 A1 * 4/2006 Zhang et al. ..... 439/607
2006/0154524 A1 * 7/2006 Huang et al. ..... 439/607
2006/0189211 A1 * 8/2006 Lang et al. ..... 439/607
2007/0117459 A1 * 5/2007 Chen ..... 439/607

* cited by examiner

*Primary Examiner*—Gary F. Paumen

(57) ABSTRACT

An electrical connector with an IEEE1394 interface is disclosed. The electrical connector includes an insulative housing, a metal shell, a plurality of terminals and a rear cover. In application, the connector can be used in both inverted type and low profile type structure, the two side walls of the metal shell are respectively stamped with a wing which consists of a connecting portion, an arch portion and a solder portion, thus making a portion of said connector can be inlaid in the circuit board and also can be engaged tightly therewith, therefore creating more space and designing freedom for the printed circuit board.

1 Claim, 3 Drawing Sheets

IEEE 1394 ELECTRICAL CONNECTOR

This is a continuation-in-part of U.S. patent application Ser. No. 11/462,445, filed on Aug. 4, 2006 now abandoned in the name of Chien-Chiu CHEN and entitled "IEEE 1394 CONNECTOR ASSEMBLY".

BACKGROUND OF THE INVENTION

1. Field of Invention

The present invention relates to an electrical connectors and more particularly to an electrical connector of IEEE 1394 interface that can be used in both inverted and low profile type design.

2. Description of Related Art 1394 interface, the full name called as IEEE1394 interface, also known as Firewire interface, is a high speed and low cost digital interface used universally in computers, communication devices and Digital Home Entertainment Equipment. IEEE1394 interface (firewire) is developed first by the Apple Corporation of USA for connection in Internet, then later standardized by the IEEE Standard Organization. At present, electrical connectors produced in this technique are used extensively and formed as a common interface standard in the electronics industry, generally this kind of connector are used for connecting various computer peripheral or digital products. Please refer to U.S. Pat. No. 6,165,015 (as shown in FIG. 1) for the related art, the connector disclosed in this patent, the design of leg 313 on the second shielding 31 and the structures 18 and 19 on the housing 1, defines a certain space between the bottom of the connector and the circuit board (not shown), thus results in the integral volume of the connector being comparatively large and occupies a relatively large space. Therefore, how to meet the design requisitions of the current industry and spare the limited room occupied by the connector itself is a key for the industry research and development.

SUMMARY OF THE INVENTION

The primary object of the present invention is to provide an electrical connector, which is designed in low profile structure so to inlay the integral connector in the circuit board thus to spare the limited room occupied by the connector itself.

The second object of the present invention is to provide an electrical connector, which is an electrical connector designed in inverted structure so as the circuit board mated therewith has much more room in designing.

To achieve the above objects, the present invention takes advantage of the following technique scheme. The electrical connector according to the present invention, mounted on a circuit board used for matching with a complementary electrical connector, comprises an insulative housing, a metal shell, a plurality of terminals and a rear cover. In the present invention, the multiple terminals are accommodated in the insulative housing, the metal shell is clasped on the insulative housing, and then the rear cover is assembled on the insulative housing. The connector uses a reversal design, make it has a conception of inverted connector. The two side walls of the metal shell are respectively stamped with a wing which consists of a connecting portion, an arch portion and a solder portion, thus a portion of the connector itself can be inlaid in the circuit board and can be engaged tightly therewith.

Compare with the existing arts, the connector of the present invention adopts an inverted and low profile design, which can spare the limited room occupied by the connector itself to meet the design requisitions of the current industry.

In order to further illustrate the technique content of the present invention detailed description with attached drawings is given hereinafter.

DETAILED DESCRIPTION OF THE INVENTION

Figure 1:
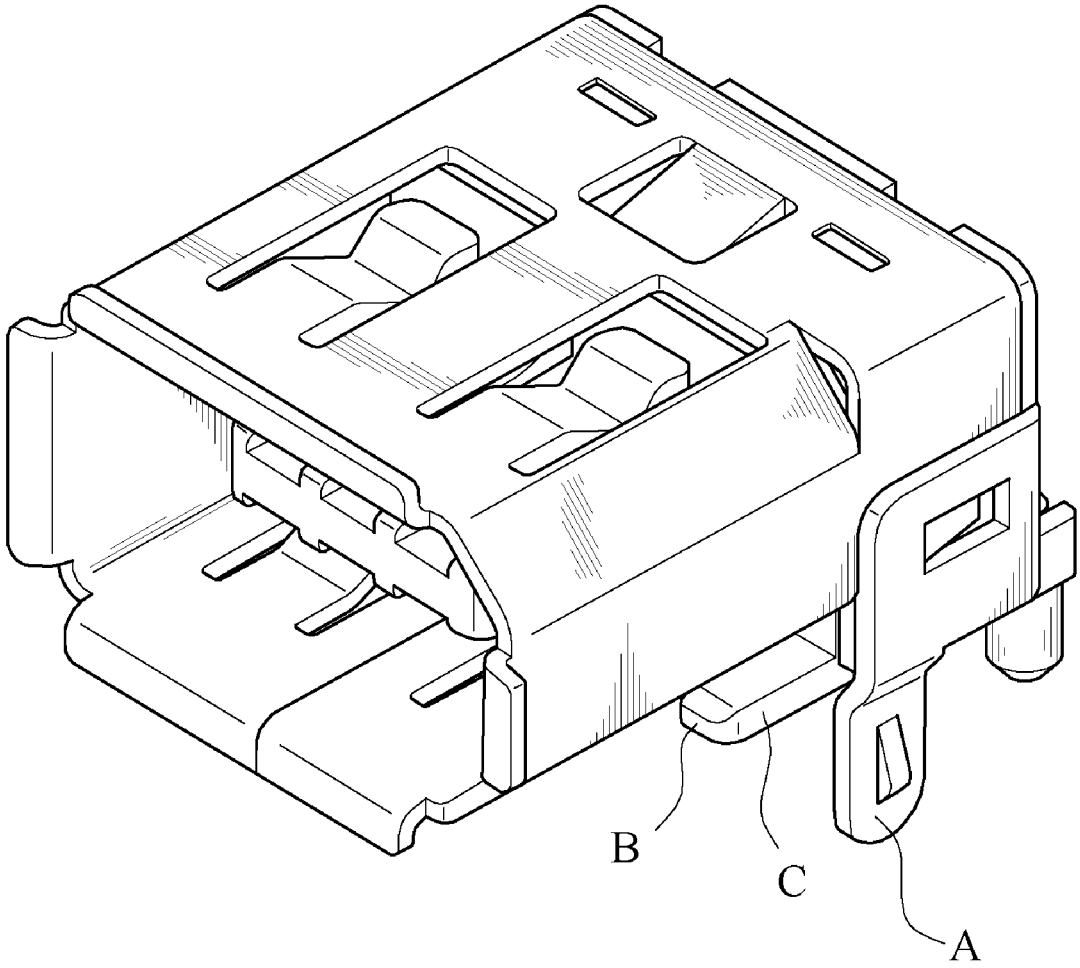
FIG. 1 (PRIOR ART)
FIG. 1 is a view showing a conventional electrical connector.
Figure 2:
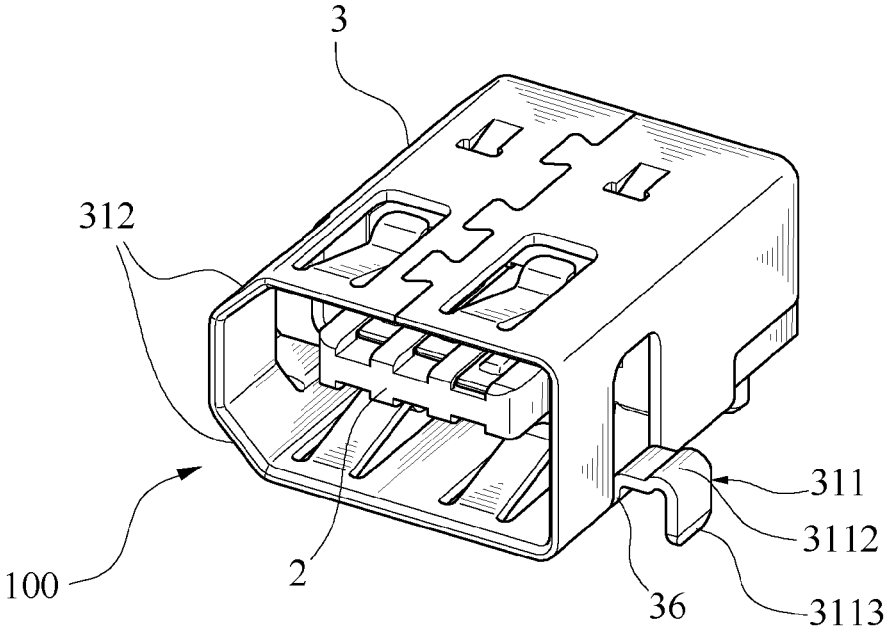
FIG. 2 is a perspective view showing an the electrical connector according to the present invention.
Figure 3:
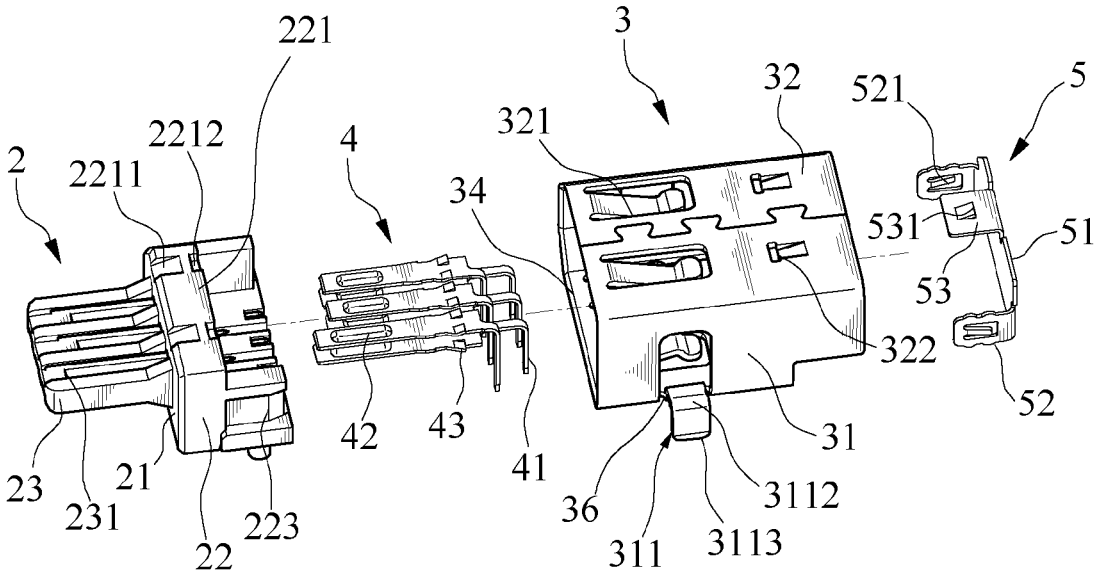
FIG. 3 is an exploded perspective view showing the electrical connector shown in FIG. 2.
Figure 4:
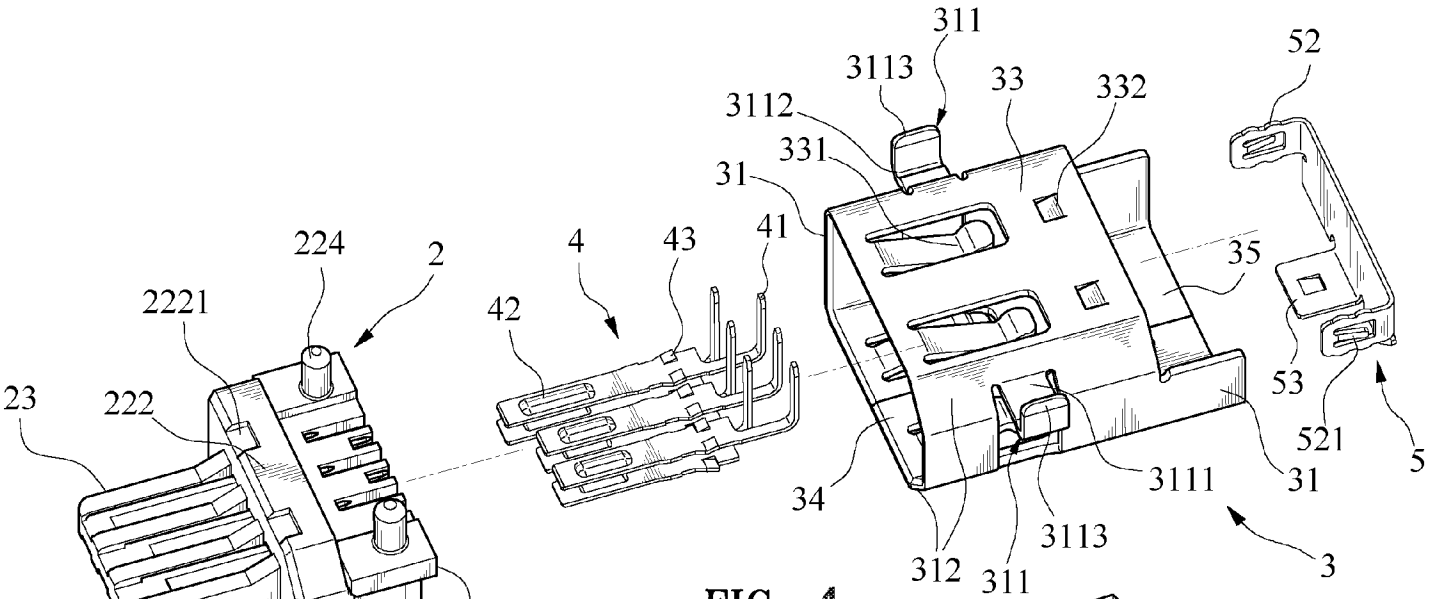
FIG. 4 is another exploded perspective view showing the electrical connector shown in FIG. 2 from a different angle.

Please refer to FIGS. 2, 3 and 4, which show an inverted and low profile connector of a preferred embodiment of the present invention. The electrical connector 100 comprises an insulative housing 2, a metal shell 3, a plurality of terminals 4 and a rear cover 5 and basic components so on.

Wherein the insulative housing 2 is divided by a mating face 21 into a comparatively large rear base portion 22 and a comparatively small front mating portion 23 thus forming a stepped body. Inside the rear base portion 22 and the front mating portion 23, there have a plurality of communicated receiving channels 231 for disposing the terminals 4. There defines two symmetrical sliding grooves 2211 on the intersecting place between the upper surface 221 of the comparatively large rear base portion 22 and the stepped mating face 21 as a sliding passageway for the abutting pieces 322 on the top wall 32 of the metal shell 3, on the rear side of the sliding grooves 2211 having two corresponding concave grooves 2212 on the same line of the sliding grooves 2211. The concave grooves 2212 are structures configured to match and clasp with the above clasping pieces 322 after they passed through the sliding grooves 2211. There also defines two symmetrical concave grooves 2221 on the intersecting place between the lower surface 222 of the comparatively large rear base portion 22 and the stepped mating face 21, configured to match with the clasping pieces 322 on the bottom wall 33 of the metal shell 3. Besides, there each has a concave portion 223 on two sides of the comparatively large rear base portion 22 for fastening the insulative housing 2 within the metal shell 3 and to make a portion of the rear base portion 22 of the insulative housing 2 exposed out of the notch 35 of the metal shell 3, it is also a matching structure for the side walls 52 of the rear cover 5, and on two sides of the exploded portion of the rear base portion 22 each having a locating pole 224 as a locating and fastening structure with the circuit board.

The metal shell 3 includes two side walls 31, a top wall 32 and a bottom wall 33, which are connected with each other forming an inserting section 34 for inserting the insulative housing 2. The top wall 32 of metal shell 4 has at least a spring piece 321 adjacent to a side of the inserting section 34, and the bottom wall 33 of the metal shell 3 having at least a similar spring piece 331. The top wall 32 and bottom wall 33 of the metal shell 3 each has two abutting pieces 322, 332 relative to another side of the spring pieces 321, 331 for matching with the concave grooves 2212, 2221 of the upper and lower surfaces 221, 222 of the insulative housing 4. The linking portions 36 between the two side walls 31 and the bottom wall 33 of the metal shell 3 each extend with a wing 311, which is stamped from the middle portion of the side wall 31, each comprising a connecting portion 3111, an arch portion 3112 and a solder portion 3113. An end of the connecting portion 3111 is connected with the linking portion 36 and extend upward to make another end thereof is higher than the above linking portion 36, thus making the connector 100 has a portion could be sunk down. The arch portion 3112, connected between the connecting portion 3111 and the solder portion 3113, is an upward oriented arc, which causes the connector 100 could engage with the circuit board closely when it is sunk down. The solder portion 3113, connected with the arch portion 3112, is a downward perpendicular structure for soldering to the circuit board. Besides, a side wall 31 of the metal shell 3 has an upper and a lower two cut corners 312, which are formed by cutting off the corners between the side walls 31 and the top wall 32 as well as the bottom wall 33 respectively.

The multiple terminals 4, each consisted of a fastening portion 41, a contact portion 42 and a plurality of clasping tabs 43, are accommodated in the terminal receiving channels 231 respectively, on the upper and lower surfaces of the middle portion of each terminal 4 having two transversely juxtaposed elastic clasping tabs 43 which has a function of positioning the terminal 4.

The rear cover 5 comprises a rear wall 51, two lateral walls 52 connected to the rear wall 51 and an upper wall 53 extended forward from an end of the middle portion of the rear wall 51. The upper wall 53 and the two lateral walls 52 each have an outward projected clasping spring piece 521, 531. The clasping spring pieces 521 on the two lateral walls 52 are adapted to abut with the side walls 31 of the metal shell 3 when the two lateral walls 52 are engaged with the concave portions 223 of the insulative housing 2. The upper wall 53 is adapted to contact with the insulative housing 2 tightly, and the spring piece 531 thereof is used for abutting with the metal shell 3.

Figure 5:
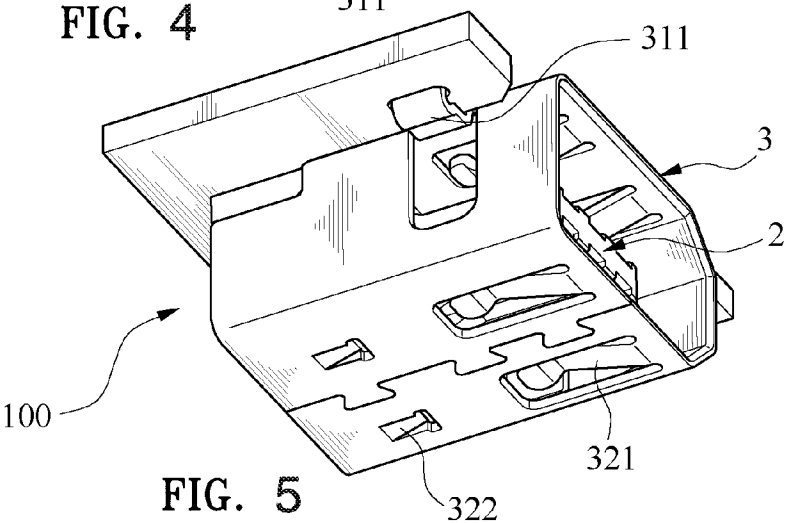
FIG. 5 is an operational perspective view showing the electrical connector shown in FIG. 2 mounted on a printed circuit board.

As shown in FIG. 5, the multiple terminals 4 are accommodated within the terminal receiving channels 231 of the insulative housing 2, and the metal shell 4 is enclosed around the insulative housing 2. Through engaging the abutting pieces 322, 332 disposed on the top wall 32 and bottom wall 33 of the metal shell 3 with the concave grooves 2212, 2221 on the corresponding positions of the insulative housing 2, thus the insulative housing 2 is secured within the metal shell 3. The two lateral walls 52 and the upper wall 53 of the rear cover 5 as well as the spring pieces 521, 531 thereof interactively abut with the concave portions 223 of the insulative housing 2 and the side walls 31 as well as the top wall 32 of the metal shell 4 respectively, thus making the insulative housing 2 can be engaged with the metal shell 3 closely under the double fixing effect. In order to achieve the design objects, the connector of present invention adopts a reverse design to make it has a conception of inverted connector, and through the design of the wings 311 on the metal shell 3, a portion of the connector can be inlaid in the circuit board, thus achieve the design requisition of saving circuit board space.

The embodiments disclosed in the present invention are illustrative only and not limitative to the scope of the present invention, any changes or modifications made by those skilled in the art via the description of the present invention without departing from spirits of the invention are considered as like structures of the invention and covered by the claims of the present invention.

What is claimed is:

1. An electrical connector (100) adapted to be mounted on a printed circuit board, the electrical connector (100) comprising:

an insulative housing (2);

a metal shell (3) having a bottom (33) and two side walls (31), the bottom and each of the two side walls (31) connected with a linking portion (36);

a plurality of terminals (4); and a rear cover (5);

wherein each of the side walls (31) of said metal shell (3) is provided with a wing (311) extending outward therefrom, each wing (311) comprises a connecting portion (3111), an arch portion (3112) and a solder portion (3113), thereby said electrical connector (100) is mounted on the printed circuit board, wherein an end of the connecting portion (3111) of each wing (311) is connected with the linking portion (36) and extends upward, the other end of the connecting portion (3111) is higher than said linking portion (36), the arch portion (3112) of said wing (311) connected with said connecting portion (3111) and said solder portion (3113) and is presented in an upward arc;

wherein said electrical connector (100) is an inverted type; and wherein said electrical connector (100) is a low profile type.

* * * * *